United States Patent [19]

Sando et al.

[11] Patent Number: 4,834,766

[45] Date of Patent: May 30, 1989

[54] METHOD FOR PREVENTING SCALE ADHESION

[75] Inventors: Yoshiteru Sando; Hiroshi Ishidoshiro; Eiichi Nakano, all of Wakayama, Japan

[73] Assignee: Sando Iron Works Co., Ltd., Wakayama, Japan

[21] Appl. No.: 225,525

[22] Filed: Jul. 28, 1988

[30] Foreign Application Priority Data

Nov. 24, 1987 [JP] Japan ..... 62-295816

[51] Int. Cl.[4] ..... D01C 1/00; B08B 30/00

[52] U.S. Cl. ..... 8/139; 8/137; 134/30

[58] Field of Search ..... 8/139, 139.1; 134/30

[56] References Cited

U.S. PATENT DOCUMENTS 3,067,070 12/1962 Loucks ..... 134/30

3,069,296 12/1962 Dashfield ..... 134/30

3,297,481 1/1967 Newman ..... 134/30

*Primary Examiner*—Paul Lieberman

*Assistant Examiner*—John F. McNally

*Attorney, Agent, or Firm*—Toren, McGeady & Associates

[57] ABSTRACT

A method for preventing the adhesion of scale on the sealing mechanism of a high pressure steamer in a process of continuous scouring of a long cloth therein, which comprises washing the cloth to be subjected to scouring with the use of weak acidic water with a pH of 5–6 outside of the steamer body, passing the thus washed cloth through the sealing mechanism of the steamer body, and then applying a scouring agent solution to the cloth in the interior of the steamer body. A durable sealing mechanism can be offered by preventing the damage of the sealing mechanism.

1 Claim, 1 Drawing Sheet

METHOD FOR PREVENTING SCALE ADHESION

BACKGROUND OF THE INVENTION

1. Field of the Invention

The present invention relates to a method for preventing the adhesion of impurities such as scale on the sealing mechanism of a high pressure steamer in continuous scouring of a long cloth.

2. Description of the Related Art

In the pretreatment of a woven or knitted cloth produced industrially, the cloth is generally subjected to scouring and bleaching with the use of wet heat in succession to singeing and desizing. As a means for scouring and bleaching of a long cloth, it has been proved that continuous pretreatment by using a high pressure steamer developed by the present applicant is most effective. In such a high pressure steamer, a sealing mechanism, which is to allow the taking in and out of a cloth continuously therethrough by preventing the leakage of pressure inside of the steamer body, must be provided at the inlet and the outlet of the cloth so as to maintain the interior of the steamer body at high pressure. Said sealing mechanism comprises a pair of seal rubber rolls pressed with each other, and the cloth to be treated is passed between said pair of seal rolls.

In carrying out the scouring treatment of a long cloth continuously by using such a high pressure steamer, it is usual that the cloth is soaked with a prescribed scouring agent solution outside of the steamer body, and then the cloth thus soaked with the scouring agent solution is supplied through the sealing mechanism into the steamer body for wet heat treatment. When there exist such impurities as waste yarns, waste size and fluffs on the surface of the cloth to be supplied into the steamer, these impurities are transferred and adhered on the surface of the seal rolls. Since such compounds as calcium bicarbonate and magnesium bicarbonate are contained together with the scouring agent in the scouring agent solution, these impurities are accumulated, pressed and solidified on the surface of seal rolls, and the thus solidified product is hardened likely as stones due to the effect of high temperature treating solution in the steamer body as well as the degeneration of the treating agent. Accordingly, the surface of the seal rolls is injured, and the sealability by using seal rubber rolls is unavoidably deteriorated.

To eliminate such a drawback, various means have been proposed for removing impurities adhered on the surface of seal rolls, but an effective and practically applicable method has not yet been developed.

SUMMARY OF THE INVENTION

Under such circumstances, the object of the present invention is to offer a method for preventing the adhesion of scale on the sealing mechanism of a high pressure steamer in subjecting a long cloth continuously to scouring therein by applying the scouring agent solution to the cloth in the interior of the steamer body after passing the cloth through the sealing mechanism instead of applying the scouring agent to the cloth outside of the steamer body.

The outline of the present inventive method for preventing the adhesion of scale on the sealing mechanism of a high pressure steamer in subjecting a long cloth continuously to scouring therein comprises washing the cloth to be subjected to scouring in a weak acidic aqueous water with a pH of 5–6 in a washing tank outside of the steamer body, passing the thus washed cloth through the sealing mechanism of the steamer body so as to prevent the adhesion of scale on the surface of the seal rolls constituting the sealing mechanism for preventing the damage of the seal rolls, and then applying a scouring agent solution to the cloth in the interior of the steamer body.

According to the present invention, therefore, since the cloth passing through the sealing mechanism contains weak acidic water, there is no danger that the scale adhered on the seal rolls is solidified. It is possible to wash and peel off the scale adhered to the sealing mechanism by such means as simple water washing, and thus a durable sealing mechanism can be offered by preventing the damage of the surface of seal rolls constituting the sealing mechanism.

DETAILED DESCRIPTION OF THE PREFERRED EMBODIMENTS

Figure 1:
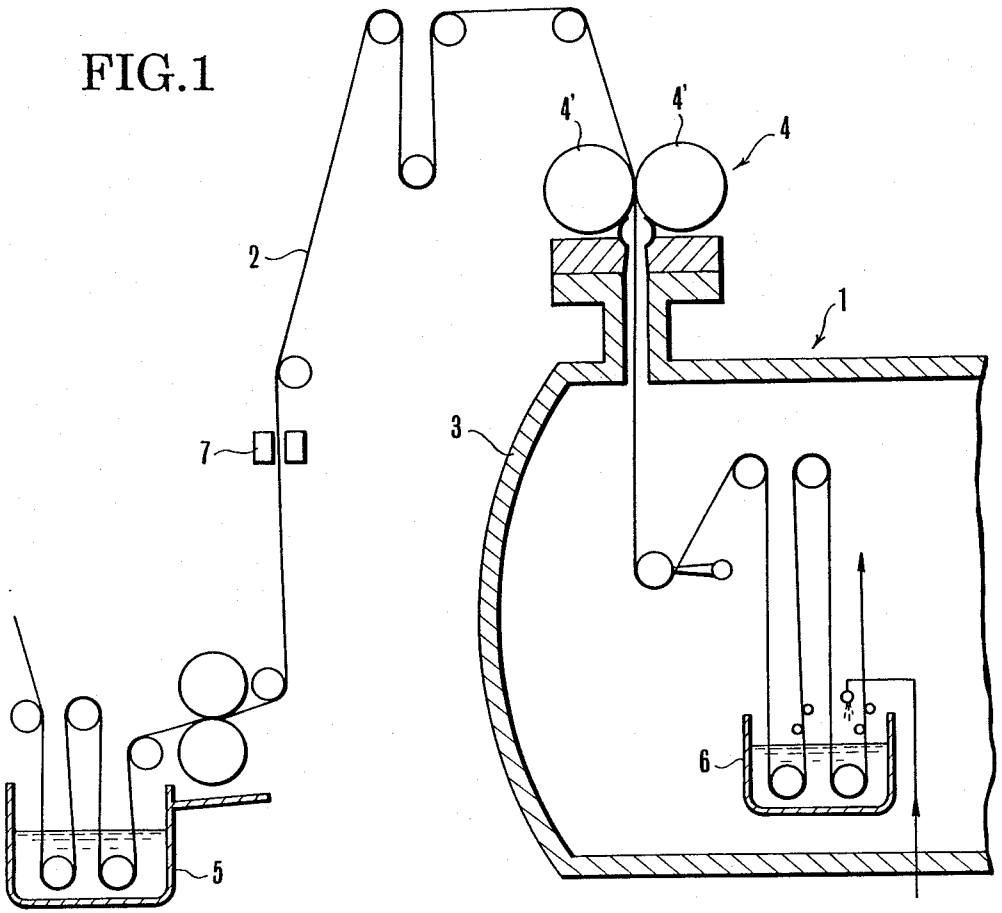
FIG. 1 is to show a high pressure steamer, particularly the cloth inlet part thereof, to perform the present inventive method for preventing the adhesion of scale on the sealing mechanism thereof in continuous scouring of a cloth.

The embodiment of the present invention will be described in detail with reference to the drawing showing an example of the apparatus therefor in the following.

In FIG. 1, 1 is a high pressure steamer for the scouring of a long cloth 2 continuously. Said high pressure steamer 1 comprises a steamer body 3 with a pair of cloth inlet sealing mechanism 4 and cloth outlet sealing mechanism (not shown in the FIGURE) respectively consisting of a pair of seal rolls for transporting the cloth 2 continuously therethrough by maintaining the interior of the steamer body 3 at high temperature and pressure. Outside of the steamer body 3, a washing tank 5 is provided for preliminary washing the cloth 2 to be introduced into the steamer body 3, and, in the interior of the steamer body 3, a scouring agent solution apply tank 6 is provided for applying a scouring agent solution to the cloth 2. 7 is a sensor for measuring the water content of the cloth 2 to be supplied into the steamer 1.

Now, the present inventive method for preventing scale adhesion by using the above-mentioned apparatus will be illustrated in the following. In the first place, weak acidic washing water is filled in the washing tank 5, and a prescribed scouring agent solution is filled in the scouring agent solution apply tank 6 interior of the steamer body 3. Then, the operation is started under the condition that the interior of the steamer body 3 is maintained at prescribed wet heat under pressure without leakage. In the course of operation, the cloth 2 is immersed in the weak acidic washing water in the washing tank 5 for preliminary washing, so that a certain extent of such impurities as waste yarns and fluffs adhered on the cloth are removed, and the cloth thus soaked with the weak acidic washing water is guided into the sealing mechanism 4. At the sealing mechanism 4, the cloth is pressed by means of a pair of seal rolls.

In this instance too, although there is a tendency that such impurities as scale remaining in the cloth is transferred to the surface of the seal rolls, since the washing water contained in the cloth is weakly acidic, the scale can difficulty be adhered on the seal rolls. Due to the present inventor's experiment, the effect of preventing the adhesion of scale on the seal rolls is superior as the acidity of washing water is increased, but in such an instance, the damage of instruments is large and further the consumption of scouring agent solution applied to the cloth in the subsequent process becomes large, so that the pH of the washing water is defined to 5–6. In the steamer body 3, the cloth passed through the sealing mechanism 4 is immersed immediately in the scouring agent solution in the scouring agent solution apply tank 6, and then the scouring treatment of the cloth in object is done under high pressure wet heat.

Since the cloth 2 to which a scouring agent solution is to be applied contains previously weak acidic washing water, it is necessary to control the alkalinity of the scouring agent solution to be applied thereto in accordance with the water content of the cloth introduced to the steamer body. Therefore, said water content is determined previously by using the sensor 7 as already mentioned, and the necessary concentration of the scouring agent solution is established by using an operation circuit (not shown in the FIGURE). The scouring agent solution with the thus established concentration is supplied successively into the scouring agent solution apply tank 6, and accordingly the scouring of a long cloth in object can be done continuously with an excellent result.

What is claimed is:

1. A method for preventing adhesion of scale on a sealing mechanism of a high pressure steamer in a process of continuous scouring of a long cloth therein, which comprises washing a cloth to be subjected to scouring with use of a weak acidic water with a pH of 5–6 outside of the steamer body, passing the cloth thus washed through the sealing mechanism of the steamer body, and applying a prescribed scouring agent solution to the cloth in the interior of the steamer body.

* * * * *